US008667627B1

(12) United States Patent
O'Malley

(10) Patent No.: US 8,667,627 B1
(45) Date of Patent: Mar. 11, 2014

(54) BLANKET AND METHOD OF MAKING SAME

(76) Inventor: Kathryn O'Malley, River Forest, IL (US)

( * ) Notice: Subject to any disclaimer, the term of this patent is extended or adjusted under 35 U.S.C. 154(b) by 1126 days.

(21) Appl. No.: 11/725,898

(22) Filed: Mar. 20, 2007

(51) Int. Cl.
*A47C 23/00* (2006.01)

(52) U.S. Cl.
USPC ..... 5/502; 5/482; 5/486

(58) Field of Classification Search
USPC ..... 5/482, 486, 497, 502
See application file for complete search history.

(56) References Cited

U.S. PATENT DOCUMENTS

| | | | | |
|---|---|---|---|---|
| 3,508,284 | A | 4/1970 | Marquette | |
| 4,005,499 | A | 2/1977 | Klein | |
| 4,069,526 | A * | 1/1978 | Deikel | 5/486 |
| 5,023,969 | A | 6/1991 | Nattrass | |
| D359,871 | S | 7/1995 | Fortran | |
| 5,708,995 | A | 1/1998 | Wu et al. | |
| 6,237,171 | B1 | 5/2001 | Allen | |
| 6,311,347 | B1 | 11/2001 | Limardi et al. | |
| 6,643,872 | B1 | 11/2003 | Buswell | |
| 6,698,043 | B2 | 3/2004 | Fabian | |
| 2006/0031987 | A1 | 2/2006 | Stanfield et al. | |

* cited by examiner

*Primary Examiner* — Fredrick Conley

(57) ABSTRACT

A multi-layer blanket or bed covering has adjacent sides or halves with different insulating properties, yet which resembles a traditional blanket, and which allows people to sleep side by side with different comfort levels for heat or coolness. The blanket preferably comprises three layers on one half of the blanket and two layers on the other. The blanket is preferably made from a single rectangular piece of material which is folded first at a location one fifth of the way in from one side of the rectangular piece of material, and folded second at a location two fifths of the way in from an opposite side of the rectangular piece of material. A stitch down the middle is preferably made after the first fold, and then the blanket is stitched around its four sides after the second fold.

9 Claims, 3 Drawing Sheets

75
20a
40a
30a
70

26a
76a
27a
75
20a
70
65
45a
43a
40a
47a
68
33a
30a
41a
32a
31a 75
20a
40a
70
55
30a 40a
50
20a
55
30a 20a
40a
30a
55
70

BLANKET AND METHOD OF MAKING SAME

The present disclosure relates generally to blankets or bed coverings, and in particular, to a dual insulation, non-electric blanket or bed covering with varying heat-cool properties. Specifically, the present disclosure relates to a multi-layer blanket or bed covering having adjacent sides or halves with different insulating properties, yet which resembles a traditional blanket, and which allows people to sleep side by side with different comfort levels for heat or coolness. A method of making the blanket is also disclosed.

BACKGROUND OF THE INVENTION

A typical blanket for a bed is generally of a uniform construction or manufacture such that it provides uniform insulating properties throughout. However, people sleeping side by side often do not want or need the same amount of insulation provided by such a uniform blanket. Use of such a uniform blanket can often result in one person being comfortable, and the other person sharing the blanket being either too hot or too cold; or one person being hot and the other cold.

One way to rectify this situation would be for one person to use a second blanket to provide additional insulation. However, a second loose blanket could move around, making it difficult to keep the second blanket in its desired location while sleeping. Further, besides the additional expense, this would result in additional time to make the bed or remove and store the extra blanket when not in use.

Another solution to this situation is to make a blanket which has different insulating properties. Numerous attempts have been made to provide blankets with different insulating properties. For example, U.S. Pat. Nos. 6,698,043, 6,643,872, 6,311,347, 6,237,171, 5,708,995, 5,023,969, 4,069,526, 4,005,499, 3,508,284, and D359,871, and U.S. Patent Application No. 2006/0031987 disclosure various examples of such attempts. However, such attempts have generally resulted in complicated, difficult to manufacture blankets. Further, such blankets often have multiple parts and can be relatively difficult or time consuming to use. Additionally, such blankets are noticeably non-uniform, can be bulky, and are otherwise visually unpleasant.

Accordingly, there is a need for a blanket which provides different insulating properties for side by side users, yet which resembles a traditional blanket, and which is easy to manufacture. The disclosed embodiment(s) of the present invention fulfill such a need, and provide numerous other benefits and advantages with respect to blankets providing dual insulation, and with respect to their manufacture.

BRIEF SUMMARY OF THE INVENTION

The present disclosure relates to a multi-layer blanket which provides different insulating properties on different sides or halves, yet resembles a traditional blanket. The blanket preferably comprises three layers on one half of the blanket and two layers on the other. The blanket preferably is stitched around its four sides. An additional stitch down the middle of the blanket is preferred to secure an edge of the middle layer of the three layered half of the blanket. Preferably the stitch down the middle is made before the third or top layer is positioned and the four sides are stitched. In this manner, the stitch down the middle remains hidden from view.

Additionally, the blanket is preferably made from a single rectangular piece of material. A first fold is made at a location approximately one fifth of the way in from one side of the rectangular piece of material, and a second fold is made approximately two fifths of the way in from an opposite side of the rectangular piece of material to form the multi-layered blanket having three layers on one half and two layers on the other. The stitch down the middle is preferably made after the first fold, and then the blanket is stitched around its four sides after the second fold.

Accordingly, it is the principal object of the present disclosure to provide a blanket which provides different insulating properties on different halves or sides.

It is a further object of the present disclosure to provide a dual insulation blanket which resembles a traditional, uniform blanket both visually and in use.

It is also an object of the present disclosure to provide a multi-layered blanket having three layers on one half and two layers on the other half, and which is preferably made from a single rectangular piece of blanket material.

Numerous other advantages and features of the disclosure will become readily apparent from the following detailed description, from the claims and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE DISCLOSED EMBODIMENTS

Figure 2:
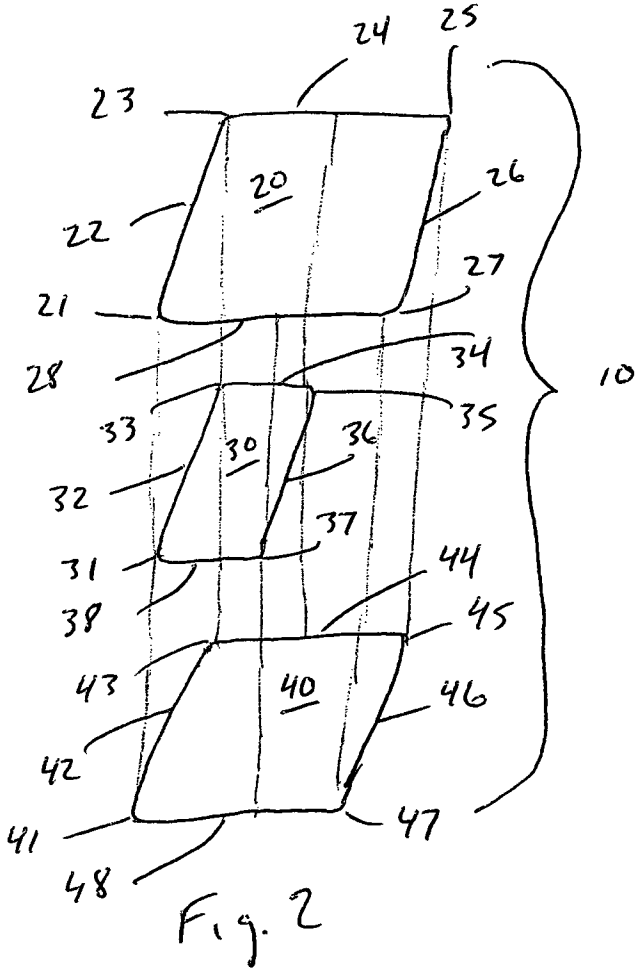
FIG. 2 is an exploded view illustrating the embodiment of the blanket of FIG. 1.

While the invention is susceptible of embodiment in many different forms, there is shown in the drawings and will be described herein in detail one or more embodiments of the present disclosure. It should be understood, however, that the present disclosure is to be considered an exemplification of the principles of the invention, and the embodiment(s) illustrated is/are not intended to limit the spirit and scope of the invention and/or the claims herein.

Figure 1:
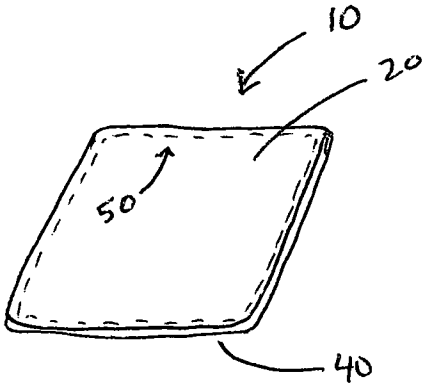
FIG. 1 is a perspective view illustrating one embodiment of the blanket of the present disclosure.

FIG. 1 is a perspective view illustrating one embodiment of the blanket of the present disclosure. As can be seen, the blanket 10 comprises a top layer 20 and a bottom layer 40. Top layer 20 and bottom layer 40 are stitched together around their outer edges by a stitch 50. Hidden between top layer 20 and bottom layer 40 is a middle layer which is preferably about one half the size of layers 20 and 40, as discussed in more detail below.

FIG. 2 is an exploded view illustrating the embodiment of the blanket of FIG. 1. As can be seen, blanket 10 is comprised of three layers, i.e., top layer 20, middle layer 30 and bottom layer 40. Top layer has four sides 22, 24, 26 and 28, and four corners 21, 23, 25 and 27. Middle layer has four sides 32, 34, 36 and 38, and four corners 31, 33, 35 and 37. Bottom layer has four sides 42, 44, 46 and 48, and four corners 41, 43, 45 and 47.

To make the blanket 10, layer 30 is placed on layer 40, with side 32 aligned with side 42, corner 31 aligned with corner 41, corner 33 aligned with corner 43, side 34 aligned with side 44, and side 38 aligned with side 48. Preferably, a stitch (not shown) is then sewn along side 36 to attach layer 30 to layer 40. Thus, when layer 20 is added, this stitch cannot be seen as it is under layer 20. Alternatively, this stitch could be made after layer 20 is provided. It is also possible to omit this stitch altogether, but then edge 36 could move relative to layers 20 and 40 when the blanket 10 is not stretched tight.

To complete the blanket 10, layer 20 is placed on layers 30 and 40, with side 22 aligned with sides 32 and 42, side 24 aligned with sides 34 and 44, side 26 aligned with side 46, and side 28 aligned with sides 38 and 48. Additionally, corner 21 is aligned with corners 31 and 41, corner 23 is aligned with corners 33 and 43, corner 25 is aligned with corner 45, and corner 27 is aligned with corner 47. Thereafter, stitch 50 is sewn around the outer edges of blanket 10 to attach sides 22, 32 and 42, sides 24, 34 and 44, sides 26 and 46, and sides 28, 38 and 48.

Prior to stitch 50 being sewn, the sides can be folded over a small amount to make a hem, with the layers being folded internally. Where three layers exist, two adjacent layers are folded together internally of the blanket, and the remaining layer is folded by itself internally of the blanket. In this manner, after stitch 50 is sewn, the edge of the blanket appears to have only two layers, as the middle layer cannot be seen. The hem also prevents fraying of the edges.

Figure 3:
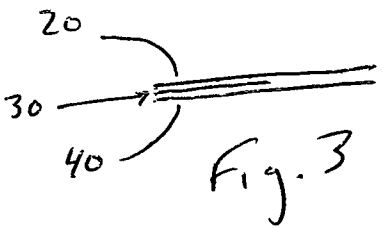
FIG. 3 is a side view illustrating the layers of the embodiment of the blanket of FIG. 1.

FIG. 3 is a side view illustrating the layers of the embodiment of the blanket of FIG. 1. As can be seen, the blanket 10 is comprised of three layers 20, 30 and 40. Middle layer 30 is positioned on one half (left half as shown) of the blanket 10. Thus, as shown, the left half of the blanket has three layers while the right half of the blanket 10 has two layers. In this manner, the blanket provides different amounts of insulting properties on different halves.

Figures 4A, 4B, 4C, 4D, 4E:
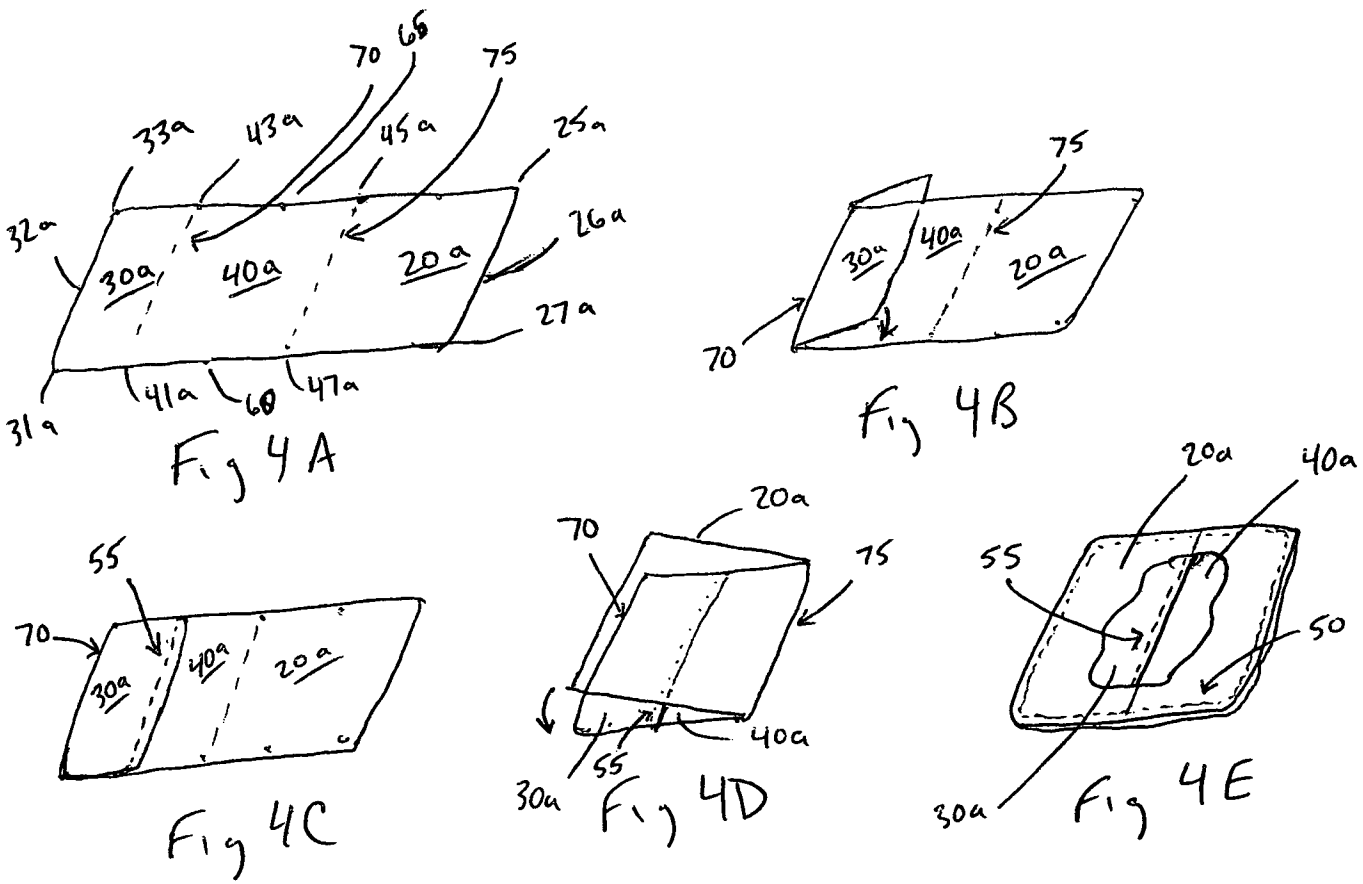
FIG. 4A is a perspective view illustrating the preferred embodiment of the blanket of the present disclosure in an unfolded, pre-manufactured position.
FIG. 4B is a perspective view illustrating a first fold in the process of making the preferred embodiment of the blanket of the present disclosure.
FIG. 4C is a perspective view illustrating a first stitch in the process of making the preferred embodiment of the blanket of the present disclosure.
FIG. 4D is a perspective view illustrating a second fold in the process of making the preferred embodiment of the blanket of the present disclosure.
FIG. 4E is a perspective view illustrating a second stitching in the process of making the preferred embodiment of the blanket of the present disclosure, and showing a cut away portion to show the middle layer and first stitch.

FIG. 4A is a perspective view illustrating the preferred embodiment of the blanket of the present disclosure in an unfolded, pre-manufactured position. In the preferred embodiment, the blanket is formed from a single rectangular piece of blanket material as shown. As described from left to right, the first one fifth of the length of the rectangular piece of blanket material, from corner 31*a* to point 41*a* and corner 33*a* to point 43*a*, serves as the middle layer 30*a*. The next two fifths of the rectangular piece of blanket material, from point 41*a* to point 47*a* and point 43*a* to point 45*a*, serves as the bottom layer 40*a*. The final two fifths of the rectangular piece of blanket material, from point 47*a* to corner 27*a* and point 45*a* to corner 25*a*, serves as the top layer 20*a*.

To make the blanket of the preferred embodiment, middle layer 30*a* is folded along a first fold line 70, defined between point 41*a* and point 43*a*, such that corners 31*a* and 33*a* are placed upon the midpoints 60 and 65, respectively, of layer 40*a*, as shown in FIG. 4B. Once middle layer 30*a* is folded flat upon bottom layer 40*a*, a stitch 55 is preferably sewn along edge 32*a* to secure layer 30*a* to layer 40*a*, as shown in FIG. 4C. Alternatively, this stitch is made after layer 20*a* is positioned, or not at all as discussed above.

Next, top layer 20*a* is folded along a second fold line 75, defined between point 45*a* and point 47*a*, such that corners 25*a* and 27*a* are placed upon the points 43*a* and 41*a* (now corners), respectively, of fold line 70, as shown in FIG. 4D. Once top layer 20*a* is folded flat upon middle layer 30*a* and bottom layer 40*a*, a stitch 50 is sewn along the outer edges of the blanket, as shown in FIG. 4E. FIG. 4E also illustrates a portion of top layer 20*a* having been cut away to reveal the middle layer 30*a* on one half of the blanket, sewn to bottom layer 40*a* by stitch 55.

Figure 5:
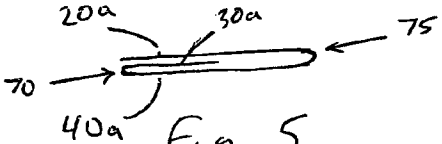
FIG. 5 is a side view illustrating the layers of the preferred embodiment of the blanket of the present disclosure.

FIG. 5 is a side view illustrating the layers of the preferred embodiment of the blanket of FIG. 4E. As can be seen, the blanket is comprised of three layers 20*a*, 30*a* and 40*a*, formed from a single rectangular piece of blanket material folded along fold lines 70 and 75. Middle layer 30*a* is positioned on one half (left half as shown) of the blanket. Thus, as shown, the left half of the blanket has three layers while the right half of the blanket has two layers. In this manner, the blanket provides different amounts of insulting properties on different halves.

Figure 6:
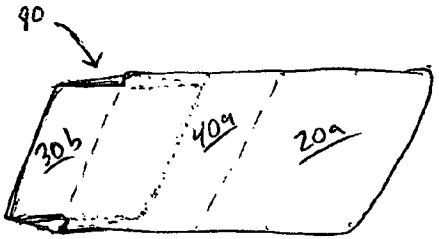
FIG. 6 is a perspective view illustrating an alternate embodiment of the blanket of the present disclosure in an unfolded, pre-manufactured position.

FIG. 6 is a perspective view illustrating an alternate embodiment of the blanket of the present disclosure in an unfolded, pre-manufactured position. This embodiment is the same as the embodiment shown in FIG. 4A, except that the middle layer 30*b* has stepped or tapered edges 80. As a result of the stepped or tapered edges 80, when layer 30*b* is folded onto layer 40*a*, the stepped or tapered edges 80 do not align with the edges of layer 40*a*, but instead remain internal of the same. Thus, when stitch 50 is sewn, there appears to be only two layers to the blanket construction as viewed around the entire outside edges of the blanket. In this manner, it is extremely difficult to tell that the blanket is non-uniform, and as such, the blanket resembles a traditional blanket. Additionally, with respect to all embodiments of the present disclosure, no special requirements or positioning of moveable parts is required to use the blanket.

The blanket embodiment of FIG. 2 can also be made to only show two layers as viewed from the outside edges, by slightly reducing the size of middle layer 30 such that its edges lie just inside the edges of layers 20 and 40. To the secure the slightly reduced layer 30 between layers 20 and 40, a double stitch would be used at stitch 50, with a second stitch sewn just inside stitch 50. This inner stitch would engage layer 30, attaching it to layers 20 and 40.

Accordingly, the blanket of the present disclosure provides two side by side users of the blanket each with a different level of insulation. One user would have three layers of insulation, while the other user would have two layers of insulation, yet the blanket resembles a traditional blanket in look and use. It is difficult to determine which side has three layers and which side has two since the layers are relatively thin and the difference in thickness between three layers and two is difficult to differentiate. Thus, an indicator can be provided on the blanket. Tags, labels or other material or print may be provided on each side to provide the indicator. The tags, labels, material or print could provide the words "hot" and "not"

respectively, or other suitable words or numbers "3" and "2" (corresponding to the number of layers), or they could be color coded red for "hot" and blue for "not," respectively.

It should be understood that the blanket could be rotated ninety degrees to provide different insulating properties on the top and bottom half In this manner, a user could have the three layers cover the user's legs and feet, while the two layer half could cover the user's body, or vie versa.

It is to be understood that the embodiment(s) herein described is/are merely illustrative of the principles of the present invention. Various modifications may be made by those skilled in the art without departing from the spirit or scope of the claims which follow.

Figure 8:
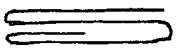
FIGS. 7-10 illustrate alternate embodiments of the blanket of the present disclosure having variations in the number of layers provided on each side of the blanket.
Figure 10:
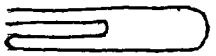
Figure 7:
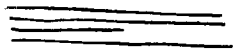
Figure 9:
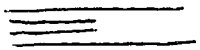

For example, it is foreseen that the blanket could have any number of layers of either side. A blanket with four and five layered halves could be made by providing an extra layer of the size of layers 20 and 40. This extra layer could be separate as in FIG. 7, or made from a single, elongated rectangular piece of blanket material as in FIG. 8, by making an additional fold as shown. Also, adding an extra middle layer 30 would result in a blanket having four and two layered halves, as shown in FIG. 9. Additional folds in a single piece of blanket material can achieve the same four and two layered halves, as shown in FIG. 10. Thus, it should be understood that any numbers of layers on either side can be provided by adding layers and/or making additional folds. Other similar modifications are contemplated.

It should be understood that the blanket can be made of any suitable material as is known in the blanket industry. Material that is relatively thin is preferable such that it is difficult to perceive a difference in thickness between the sides of the blanket having a different number of layers. For example, the blanket layers are preferably constructed from 100% cotton, although a cotton blend or any other suitable material can be used so long as the structure, functions and/or purposes of the blanket disclosed herein are achieved.

What is claimed is:

1. A blanket comprising: a bottom layer, a middle layer, and a top layer, wherein the middle layer is approximately one half the size of the bottom layer and the top layer, and wherein the bottom layer, the middle layer and the top layer are attached together to form the blanket, with three layers on one half of the blanket and two layers on the other half of the blanket, wherein the layers are attached via stitching and the stitching is a stitch around the outer edges of the blanket.

2. The blanket of claim 1, wherein an additional stitch is provided along an edge of the middle layer.

3. The blanket of claim 1, wherein the blanket visually resembles a uniform construction.

4. A blanket comprising:

a first half, and a second half, wherein the first half has at least two layers, wherein the second half has at least one more layer than the first half, and wherein the layers are attached such that only two layers are visable from the exterior of the blanket.

5. A blanket comprising:

a generally rectangular piece of blanket material defining a length, and defining a first section of one fifth the length, a second section of two fifths the length, and a third section of two fifths the length, wherein the first section is folded over and onto half of the second section, and the third section is folded over and onto the first and second section to form the blanket, with three layers on one half of the blanket and two layers on the other half of the blanket.

6. The blanket of claim 5, wherein the blanket visually resembles a uniform construction.

7. The blanket of claim 5, wherein the layers are attached via stitching.

8. The blanket of claim 7, wherein the stitching is a stitch around the outer edges of the blanket.

9. The blanket of claim 8, wherein an additional stitch is provided along an edge of the first section.

* * * * *